US007706733B2

(12) United States Patent
Pearce et al.

(10) Patent No.: US 7,706,733 B2
(45) Date of Patent: Apr. 27, 2010

(54) MECHANISM FOR TRANSFIX MEMBER WITH IDLE MOVEMENT

(75) Inventors: David James Pearce, Herts (GB); Martin Richard Walsh, Herts (GB)

(73) Assignee: Xerox Corporation, Norwalk, CT (US)

( * ) Notice: Subject to any disclaimer, the term of this patent is extended or adjusted under 35 U.S.C. 154(b) by 246 days.

(21) Appl. No.: 11/784,954

(22) Filed: Apr. 10, 2007

(65) Prior Publication Data

US 2008/0253812 A1 Oct. 16, 2008

(51) Int. Cl.
*G03G 15/16* (2006.01)

(52) U.S. Cl. ..... 399/307; 399/326; 118/24; 474/155

(58) Field of Classification Search ..... 399/307; 198/781.03, 781.09, 781.1, 790
See application file for complete search history.

(56) References Cited

U.S. PATENT DOCUMENTS

| | | | | |
|---|---|---|---|---|
| 3,559,571 | A | 2/1971 | Scherer et al. | |
| 4,264,223 | A | 4/1981 | Bemis et al. | |
| 5,057,875 | A * | 10/1991 | Itoh | 399/147 |
| 5,539,508 | A | 7/1996 | Piotrowski et al. | |
| 6,070,047 | A * | 5/2000 | Ichinose et al. | 399/350 |
| 6,583,803 | B2 | 6/2003 | Poole et al. | |
| 2003/0095170 | A1 | 5/2003 | Johnson | |
| 2006/0067753 | A1 * | 3/2006 | Katayanagi | 399/329 |
| 2006/0250467 | A1 | 11/2006 | Folkins | |

FOREIGN PATENT DOCUMENTS

| | | | |
|---|---|---|---|
| EP | 0599217 A | | 6/1994 |
| JP | 11024355 A | * | 1/1999 |
| JP | 2002039296 A | * | 2/2002 |
| JP | 2006018518 A | * | 1/2006 |

OTHER PUBLICATIONS

EP Search Report, European Patent Office, Munich Germany, Jun. 23, 2009.

* cited by examiner

*Primary Examiner*—David M Gray
*Assistant Examiner*—Roy Yi
(74) *Attorney, Agent, or Firm*—Maginot, Moore & Beck LLP

(57) ABSTRACT

A printer includes an idler movement mechanism that rotates a transfix member at a speed corresponding to a rotational speed for a rotating image member before moving the transfix member into engagement with the rotating image member to form a nip. The printer includes a rotating image member for receiving colorant from a print head to form an image on the rotating image member, a motor having rotational output that is coupled to the rotating image member for rotating the rotating image member at a first surface speed, a transfix member for forming a nip with the intermediate print member to transfer the image from the intermediate print member to media in the nip, the transfix member being moveable from a first position, in which the transfix member does not form a nip with the intermediate print member, to a second position, in which the transfix member forms the nip with the intermediate print member, and a rotational transfer link for coupling the transfix member in the first position to the rotation of the rotating image member so the transfix member rotates at a second surface speed that corresponds with the first surface speed as the transfix member is moved to the second position to form the nip with the rotating image member rotating at the first surface speed.

18 Claims, 4 Drawing Sheets

MECHANISM FOR TRANSFIX MEMBER WITH IDLE MOVEMENT

TECHNICAL FIELD

The device described herein generally relates to offset printers that transfer a printed image from an intermediate member to media. More specifically, the device relates to offset printers that use a transfix or transfer member to improve the transfer of the printed image from the intermediate member to the media.

BACKGROUND

Modern printers use a variety of inks to generate images from data. These inks may include liquid ink, dry ink, also know as toner, and solid ink. So-called "solid ink" refers to ink that is loaded into a printer as a solid, which is typically in stick or pellet form. The solid ink is melted within the printer to produce liquid ink that is supplied to a print head for ejection onto media or an intermediate member to generate a printed image from image data. These solid ink printers typically provide more vibrant color images than toner or liquid ink jet printers.

A schematic diagram for a typical solid ink imaging device is illustrated in FIG. 1. The solid ink imaging device, hereafter simply referred to as a printer 100 has an ink loader 110 that receives and stages solid ink sticks. The ink loader 100 has a plurality of feed channels in which the ink sticks are placed. Typically, a feed channel is provided for each color of ink used in the printer. For example, a color printing machine has a feed channel for each of the black, cyan, yellow, and magenta colors that are used for color printing.

The ink sticks progress through a feed channel of the loader 110 until they reach an ink melt unit 120. The ink melt unit 120 heats the portion of an ink stick impinging on the ink melt unit 120 to a temperature at which the ink stick melts. The liquefied ink is supplied to one or more print heads 130 by gravity, pump action, or both. Printer controller 180 uses the image data to be reproduced to control the print heads 130 and eject ink onto a rotating print drum 140 as image pixels for a printed image. Media 170, such as paper or other recording substrates, are fed from a sheet feeder 160 to a position where the image on the drum 140 can be transferred to the media. To facilitate the image transfer process, a pressure roller 150, sometimes called a transfix or transfer member, presses the media 170 against the print drum 140. Offset printing refers to a process, such as the one just described, of generating an ink or toner image on an intermediate member and then transferring the image onto some recording media or another member.

In some offset printing processes, the intermediate member is brought to a stop so the transfix member can be brought into contact with the intermediate member to form a nip. The leading edge of the media is then fed into the nip as the intermediate member is driven to commence rotation of the member. The rotation of the intermediate member also drives the free-wheeling transfix member so the two rotating members push the media through the nip for the transfer of the image from the intermediate member to the media. While stopping the rotation of the intermediate member facilitates the coordination of the media and transfix member with the intermediate member, it reduces the number of images that can be generated by the printer. Consequently, offset printing processes have been developed that continue to rotate the intermediate member while coordinating the movement of the media and transfix member with the intermediate member.

While these offset printing processes increase printing productivity, they also introduce additional mechanical stresses to the transfer process. One issue is related to the movement of a stationary transfix member into engagement with the rotating intermediate member. The inertial load of the stationary transfix member requires a brief period of time for the intermediate member to bring the transfix member up to the appropriate speed for transfer of the image. Additionally, some slippage between the two members may occur as the rotating intermediate member imparts its driving force to the transfix member. The impact of the stationary transfix member on the rotating intermediate member also puts some stress on the motor driving the intermediate member. Responding to the repetitive load of the stationary transfix member being applied to the intermediate member over the long term may reduce the operational life of the motor.

SUMMARY

A printer includes an idler movement mechanism that rotates a transfix member at a speed corresponding to a rotational speed for a rotating image member before moving the transfix member into engagement with the rotating image member to form a nip. The printer includes a rotating image member for receiving colorant from a print head to form an image on the rotating image member, a motor having rotational output that is coupled to the rotating image member for rotating the rotating image member at a first surface speed, a transfix member for forming a nip with the intermediate print member to transfer the image from the intermediate print member to media in the nip, the transfix member being moveable from a first position, in which the transfix member does not form a nip with the intermediate print member, to a second position, in which the transfix member forms the nip with the intermediate print member, and a rotational transfer link for coupling the transfix member in the first position to the rotation of the rotating image member so the transfix member rotates at a second surface speed that corresponds with the first surface speed as the transfix member is moved to the second position to form the nip with the rotating image member rotating at the first surface speed.

A system for coordinating rotation of a transfix member with a rotating image member in a printer may also regulate the amount of slack in the rotational transfer link coupling a transfix member to a rotating power source. The system includes a transfix member driver for generating rotational power, and a rotational transfer link for transferring rotational power to a transfix member to rotate the transfix member at a speed corresponding to a speed of a rotating image member in response to the transfix member being located at a first position out of engagement with the rotating image member, the rotational transfer link effectively disengaging the transfix member from the transfix member driver in response to the transfix member moving into engagement with the rotating image member to form a nip for transferring an image from the rotating image member to a media in the nip, and a tension adjuster for adjusting tension in the rotational transfer link to remove slack from the rotational transfer link as the transfix member moves from the location out of engagement with the rotating image member to the location in engagement with the rotating image member.

BRIEF DESCRIPTION OF THE DRAWINGS

Features of the present invention will become apparent to those skilled in the art from the following description with reference to the drawings, in which.

DETAILED DESCRIPTION

The term "printer" refers, for example, to reproduction devices in general, such as printers, facsimile machines, copiers, and related multi-function products. While the specification focuses on a system that rotates the transfix roller in solid ink printers, the system may be used with any printer that uses a belt or roller to assist in transferring the image to media.

Figure 1:
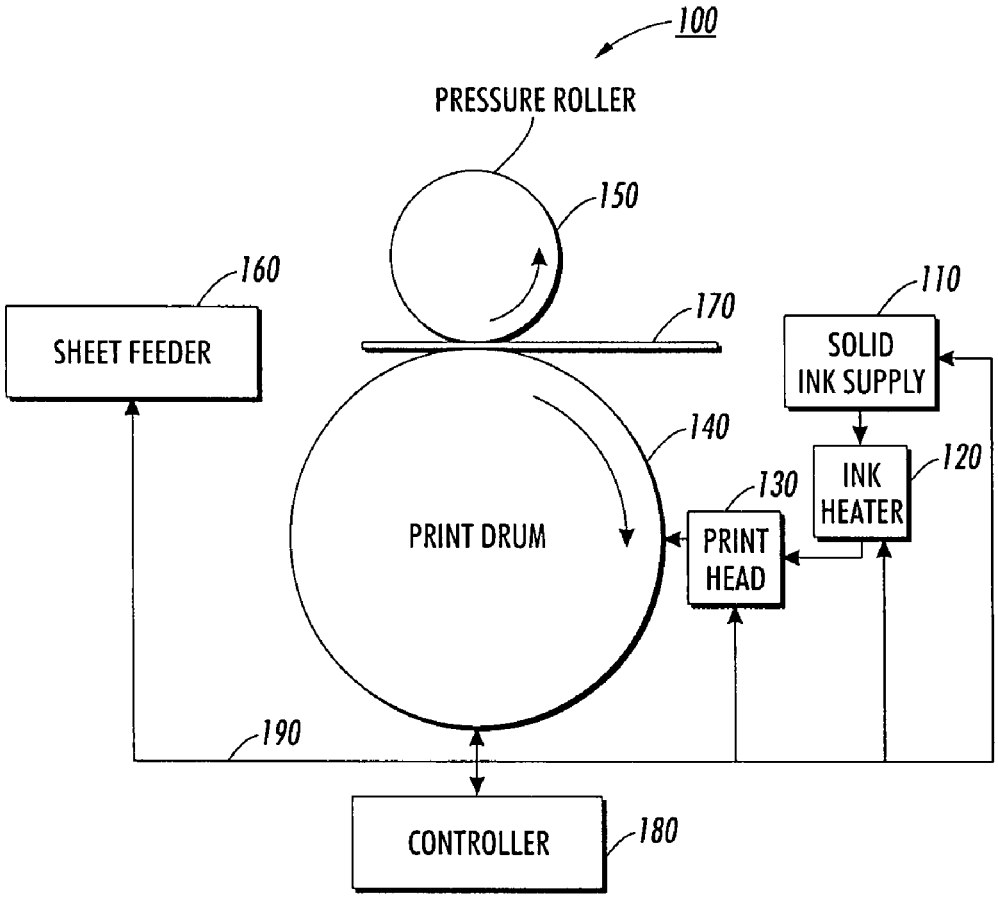
FIG. 1 PRIOR ART
FIG. 1 is a general schematic diagram of a prior art high speed, solid ink printer.
Figure 2:
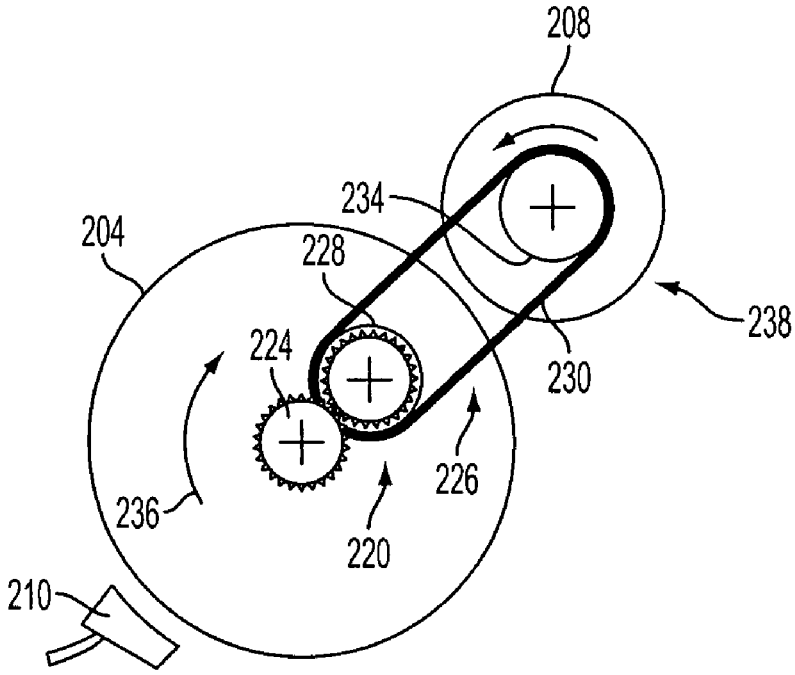
FIG. 2 is a side plan view of a transfix member coupled to a print drum for idle movement when the transfix roller is spaced from the print drum.
Figure 3:
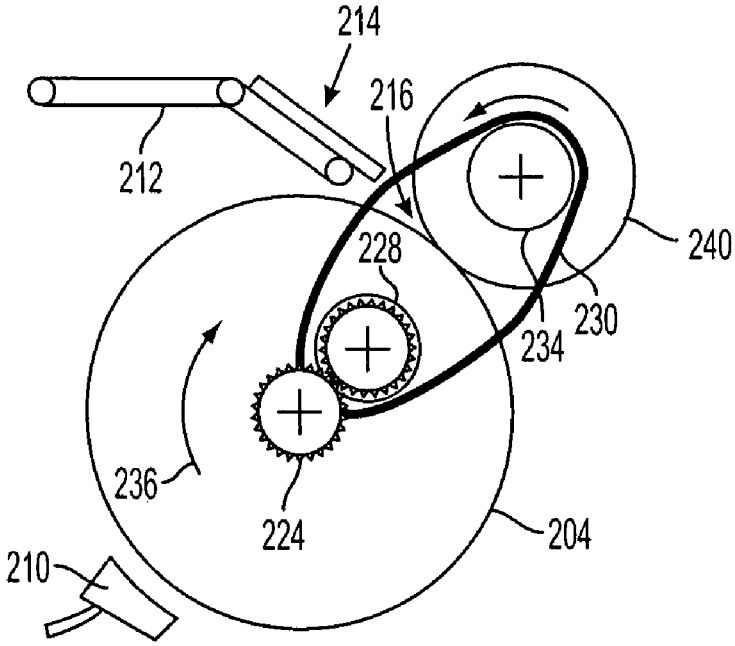
FIG. 3 is a side plan view of the transfix member and print drum of FIG. 2 with the transfix roller in contact with the print drum.

Simplified side views of printer internal components are shown in FIG. 2 and FIG. 3. The printing subsystem includes a print drum 204, a transfix member 208, and a print head 210. The print drum is driven by a motor (not shown) so the circumferential surface of the drum rotates past the print head 210. Print head 210 is operated by a print head controller (not shown) to eject ink onto the circumferential surface of the print drum to form an image. The ink may be supplied to the print head from a melting assembly, if the printer is a solid ink printer, or from a cartridge. A printer controller (not shown) synchronizes the delivery of a media sheet 214 from a media supply tray along a feed path by a conveyor 212 to the nip 216 between the transfix member 208 and the print drum 204. The pressure in the nip assists in the transfer of the image from the print drum to the media sheet in the nip. The sheet then continues to an output tray for retrieval by a user. Although the printing subsystem has been described with reference to a print drum, other types of rotating image members may be used, such as rotating belts and the like.

In previously known printing subsystems, the print drum is brought to a stop so the transfix member may be brought into contact with the print drum. The print drum then begins to rotate to spin the free wheeling transfix member. That is, the frictional contact between the print drum and the transfix member is sufficient for the print drum to impart rotational energy to the transfix member and rotate the transfix member. The media sheet may then be brought into the nip 216 as the image on the print drum approaches the nip. While this arrangement is sufficient to effectively transfer the image from the print drum to the media sheet, it requires the print drum to be stopped for engagement with the transfix member.

In the printing subsystem shown in FIG. 2, the print drum has been provided with an idler movement mechanism 220 that rotates the transfix member 208 at a speed that corresponds to the speed of the print drum 204 when the transfix member 208 is spaced from the print drum 204. When the printer controller operates a translational linkage to move the transfix member 208 into engagement with the print drum 204, the idler movement mechanism disengages from the transfix member 208 so the circumferential surface of the print drum 204 can drive the circumferential surface of the transfix member 208 through frictional pressure. Because the transfix member 208 was rotating at a surface speed corresponding to and approximating the surface speed of the print drum 204, a relatively small amount of slippage occurs as the transfix member 208 transitions to being driven by the circumferential surface of the print drum 204. A tension adjuster, discussed in more detail below, may be used to add tension to a rotational transfer link of the idler movement mechanism 220 so it remains in position for reengaging the transfix member 208 when it returns to the position where the transfix member is spaced from the print drum 204. Thus, the transfix member 208 remains in motion whether it is being driven by the circumferential surface of the print drum 204 or by the idler movement mechanism 220. Because the speed of the transfix member 208 corresponds to the speed of the print drum at all times, the print drum need not be stopped for image transfer operations. Accordingly, a printer incorporating the idler movement mechanism is able to produce more media sheets bearing images per unit of time.

An exemplary idler movement mechanism 220 shown in FIG. 2 includes a transfix member driver 224, and a rotational transfer link 226. The transfix member driver 224 shown in the exemplary mechanism of FIG. 2 is a spur gear that is centered on the longitudinal center axis of the print drum 204. The rotational transfer link 226 is comprised of spur gear 228, an endless belt 230, and a pulley 234. The spur gear 228 may be mounted in a bushing within a frame or other neighboring structure that is relatively independent of the print drum 204. The print drum 204 may be driven by a motor (not shown) that is operated by a printer controller (not shown). The motor may be coupled to a shaft extending from one end of the longitudinal center axis of the print drum 204. For ease of illustration, the motor drives the end of the print drum 204 that is not shown in FIG. 2, although the motor may be coupled directly to spur gear 224 or indirectly through another gear train or belt arrangement to drive the print drum 204. Also for ease of illustration, the translational linkage that moves the transfix member 208 into and out of engagement with the print drum 204 is not shown. Such a linkage and its control are well-known within the offset printing art, and may include, for example, a motorized ball screw mechanism, a hydraulic mechanism, a rack and pinion mechanism or a solenoid system moves the transfix member 208 with respect to the print drum 204.

The transfix member 208 is moved between two operating positions. The first position 238, shown in FIG. 2, is spaced from the print drum 204 and the second position 240, shown in FIG. 3, is where the transfix member engages the print drum. The transfix member 208 is kept at the first position until it is needed to form the nip 216 with the print drum. By keeping the transfix member at the first position, the print drum and its driving motor do not experience the inertial load of the transfix member. Although the idler movement mechanism does load the print drum and motor with the transfix member more than the previously known transfix member arrangements, keeping the transfix member at the first position is still beneficial as it helps prevent wear that occurs when the circumferential surface of the print drum and the circumferential surface of the transfix member are engaged with one another.

The endless belt 230 of the rotational transfer link 226 shown in FIG. 2 may be comprised of a suitable force transferring, resilient material. The belt may be constructed to have a solid form with a relatively smooth surface or it may have an interlocking fiber structure for selectively meshing with the teeth of the spur gears 224 and 228. The spur gears 224 and 228 may be made from a durable and relatively inexpensive polymer material, such as nylon, although other suitable materials may be used. The teeth of the spur gears may extend across the longitudinal length of the gears or teeth may be located at one or both ends of the gears. In the later configuration, the circumferential area between the teeth may be smooth or include a groove for accommodating the endless belt 230. In the grooved configuration, the endless belt may be formed as a V-belt having a roughly trapezoidal cross-section. As shown in FIG. 2, the teeth of the spur gears are located on one end of two gear bodies and the spur gear 224 has an enlarged diameter cylindrical body offset from the teeth around which the endless belt 230 is mounted. The other end of the endless belt is mounted around a pulley 234, which is centered on the longitudinal center axis of the transfix member 208. The pulley 234 may be made from the same material as the spur gears 224 and 228. A groove may also be provided in pulley 234 to help maintain the belt in engagement with the pulley. In embodiments in which the endless belt 230 is comprised of interlocking fibers or chains, the pulley 234 may be a gear or sprocket for meshing with the endless belt. While idler movement mechanism 220 has been discussed with reference to one end of the print drum 204 and transfix member 208, both ends may include an idler movement mechanism 220 if desired.

As shown in FIG. 2, the motor rotates the print drum in the direction of arrow 236 and this rotation causes spur gear 228 to rotate in the same direction. The engagement of the teeth on spur gear 228 with the teeth on the spur gear 224 rotates gear 224 in the opposition direction. The opposite rotation of spur gear 224 is required for moving the endless belt 230 in the direction that enables transfix member 208 to cooperate with the print drum 204 in the nip 216. Otherwise, the two rotating members would interfere with one another. As the endless belt 230 rotates with the spur gears 224 and 228 and the pulley 234, the transfix member 208 and the print drum 204 approximate one another's speed. Thus, the idler movement mechanism causes the transfix member 208 to rotate at approximately the speed of the print drum 204 when it is in the first position.

As the transfix member is driven by the endless belt 230, the belt may be taut or straight on one side, while the other side of the belt arrangement may develop slack, depending on the tension of the belt. The slack side may, if not fully taut, display a bowed or arcuate shape. The proper amount of tension on the belt 230 may be experimentally determined. Tension that helps keep the endless belt 230 taut on both sides may be maintained by positioning the center of the pulley 234 at an appropriate distance from the center of the spur gear 228.

Referring now to FIG. 3, the transfix member 208 has been moved from the first position 238 to the second position 240. In this position, the transfix member 208 contacts the print drum 204 as a media sheet 214 approaches the nip 216. The rotational speed of the transfix member 208 obtained at the first position enables the transfix member 208 to engage the rotating print drum 204 without disrupting the rotating of the print drum. Because the distance between the center of the pulley 234 and the center of the spur gear 228 has substantially decreased, the endless belt is no longer maintained in tension and may go slack on both sides of the belt. In this condition, the belt 230 may slip with respect to the pulley 234 and the spur gear 228. In position 240, however, the rotation of the transfix member is driven by the rotation of the circumferential surface of the print drum acting on the circumferential surface of the transfix member in the nip 216. Thus, the transfix member 208 continues to rotate at a surface speed that corresponds to the surface speed of the print drum.

The term "corresponds" refers to the speeds of the transfix member 208 and the print drum 204 being related to one another without necessarily being the same speed. If speed is measured in revolutions per minute (RPM), the diameter of the print drum and the transfix member determines the speed of the respectively rotating structure. That is, a smaller structure may travel two revolutions for a single revolution of a larger structure. Nevertheless, the relative surface speed of the two structures in a nip may be approximately the same so no slippage occurs in the nip. When two rotating structures cooperate in a nip so slippage between the surfaces of the two structures is negligible, the surface speeds of the two structures correspond to one another. Thus, the surface speed of the transfix member 208 and the print drum 204 correspond to one another and effective transfer of an image from the print drum to a media sheet may occur in the nip 216.

Figure 4:
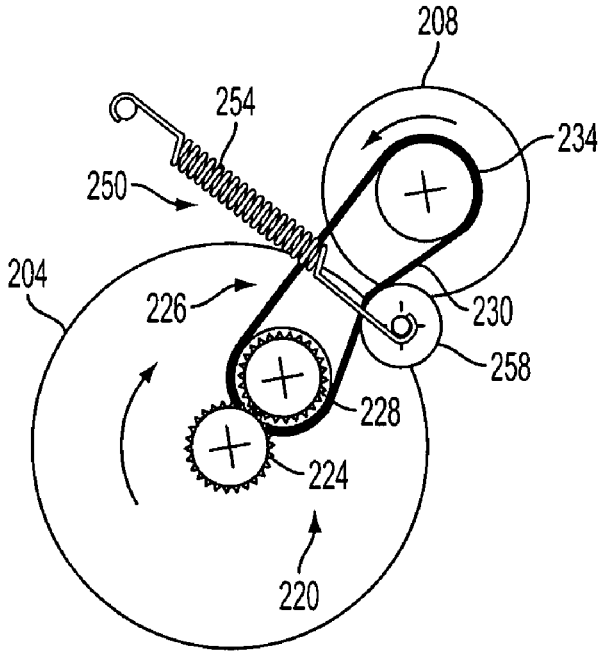
FIG. 4 is a side plan view of a transfix member coupled to a print drum with a tensioning mechanism to remove slack from the endless belt coupling the transfix member to the print drum when the transfix member is approaching the print drum.

In the embodiment shown in FIG. 4, idler movement mechanism 220 includes a tension adjuster 250 that interacts with the rotational transfer link 226 to keep excess slack from forming in the link. The tension adjuster 250 may include a biasing member 254 and an adjusting pulley 258. The biasing member has one end mounted to a fixed point, such as pin 260, and its other end mounted to a shaft extending through the center of the adjusting pulley 258. The shaft extending through the adjusting pulley 258 may be mounted in a slot in a frame or other stationary member (not shown). The slot roughly parallels the media path through the nip 216.

In the exemplary embodiment shown in FIG. 4, the biasing member 254 is a coil spring, although other biasing members may be used, such as one or more elastic belts or bands, for example. The spring has a spring constant and length sufficient to engage the adjusting pulley 258 on the side of the endless belt 230 that is opposite the side to which the biasing member is fixedly mounted. At the end of the travel range of the adjusting pulley 258 away from the endless belt 230, the biasing member pulls the adjusting pulley 258 into contact with the endless belt. When the transfix member 208 is in the first position away from the rotating image member, the endless belt 230 is sufficiently taut that it pushes against the adjusting pulley 258 to extend the biasing member away from its fixed end. In response to the transfix member 208 being moved towards engagement with the rotating imaging member at the second position, the endless belt becomes less taut and the biasing member 254 pulls the adjusting pulley towards the fixedly mounted end of the biasing member. This movement takes up slack in the endless belt until a position is reached where the belt against resists the pull of the biasing member presented through the adjusting pulley 258. Thus, when the transfix member 208 reaches the second position, the biasing member has sufficiently removed slack from the endless belt 230 that the belt remains in engagement with the pulley 234 and the spur gear 228.

By regulating the slack in the rotational transfer link, the tension adjuster 250 reduces the risk that the rotational transfer link 226 remains engaged with the transfix member 208 and the print drum 204 through its movement. The biasing member does not, however, keep the transfix member sufficiently in contact with the rotational transfer link that the motor driven spur gear 224 controls the rotational speed of the transfix member. Instead, the frictional drive of the print drum against the surface of the transfix member dominates the rotation of the transfix member. The balance of the tension constant in the biasing member 254, the travel distance of the adjusting pulley 258, and the length of the rotational transfer link may be determined empirically. Controlling the slack in the rotational transfer link with the tension adjuster also enables the driving force imparted to the transfix member through the rotational transfer link to be reduced more gradually. As a consequence, the transfix member of FIG. 4 loses less speed as it is moved towards the print drum than the transfix member of FIG. 2. As a consequence, the contact of the transfix member 208 in FIG. 4 with the print drum 204 is smoother.

Figure 5:
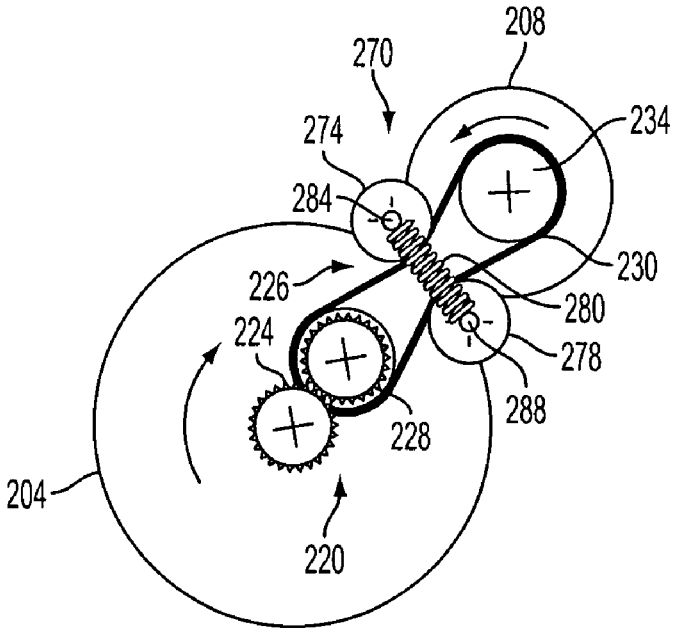
FIG. 5 is a side plan view of an alternative embodiment of the tensioning mechanism shown in FIG. 4.

Referring now to FIG. 5, another embodiment of a tension adjuster is depicted. The tension adjuster 270 includes a pair of adjusting pulleys 274 and 278 that are coupled to one another by a biasing member 280. In this embodiment, a second biasing member is coupled on the backside of the adjusting pulleys 274 and 278. The biasing members are closely matched in their tension constants and length. Each of the biasing members are coupled to a shaft 284 that is aligned with the longitudinal center of the pulley 274 and a shaft 288 that is aligned with the longitudinal center of the pulley 278. The discussion of the tension adjuster 270 proceeds with reference to the biasing member 280. The reader should understand that the description of biasing member 280 also applies to the biasing member on the backside of the adjusting pulleys 274 and 278.

The biasing member 280 pulls the two adjusting pulleys towards one another. Because the two adjusting pulleys are on opposite sides of the endless belt 230, they squeeze the belt between them under the influence of the biasing members 280. The endless belt 230 also exerts a force on the adjusting pulleys in the opposite direction. When the transfix member 208 is in the first position out of engagement with the rotating image member, the endless belt exerts its greatest force against the pulleys and the pulleys effectively remove all slack from the endless belt. In response to the transfix member 208 moving to its second position, the belt exerts less force against the pulleys and the biasing member 280 is able to pull the pulleys closer together. This movement takes slack out of the endless belt, but not as efficiently as it did when the transfix member was in the first position. Thus, the circumferential surface of the print drum is able to dominate the driving of the transfix member as it approaches the second position, yet the tension adjuster maintains sufficient pressure on the endless belt that it cannot disengage from the pulley and/or gear around which it is mounted. The balance of tensioning member length, tension constant, and endless belt length may all be determined empirically.

Figure 6:
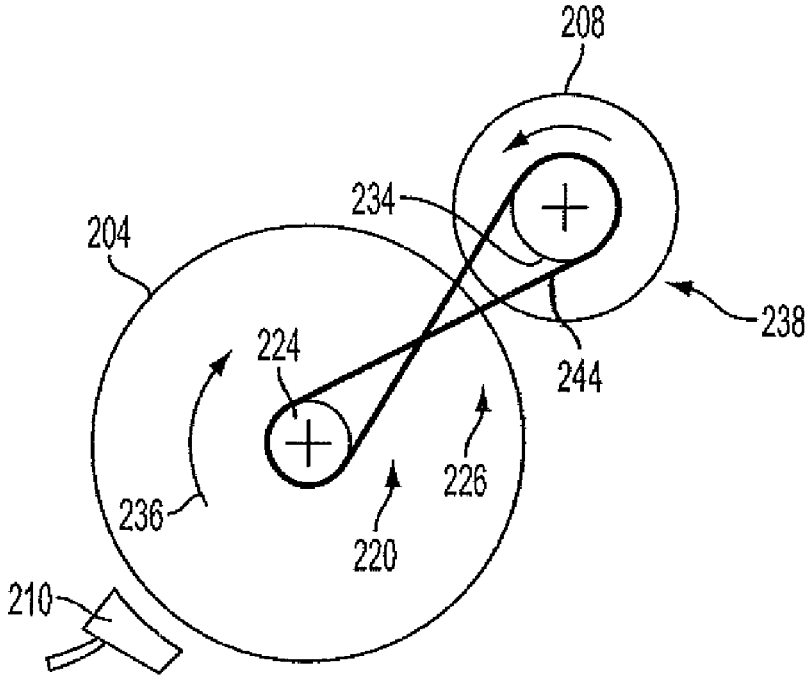
FIG. 6 is a side plan view of a transfix member coupled to a print drum with a crossed belt.

The discussion above presents several embodiments of an idler movement mechanism and the advantages of the various embodiments. The reader should appreciate other arrangements and variations are possible without departing from the principles noted in the discussion. For example, the idler movement mechanism may be configured so a gear train is not required to provide a pulley with a rotation opposite that of the print drum. In one embodiment shown in FIG. 6, the mechanism may use a crossed belt 244 with a crossing pattern to drive the transfix member in the opposite direction. In this embodiment, the cross belt is preferably not a V belt and may be, for example, a belt with a circular cross section. The grooves of the pulleys may be skewed with each other such that the belt does not contact itself as it moves from pulley to pulley.

The idler movement mechanism may also be implemented without using a belt. For example, the printer may include a separate motor for rotating the transfix member while it is the first position. The controller operating the motor for the transfix member may selectively engage the motor to the transfix member so the motor rotates the transfix member in the first position, but the print drum drives the member in the second position. Provided the drum motor and the transfix member motor are variable speed motors, the motor speeds of the drum motor and the transfix member motor may be controlled by the same controller. The surface speed of surface of the drum may be adjusted to be the same as the surface speed of surface of the transfix member when the drum is in contact with the transfix member.

Variations and modifications of the present invention are possible, given the above description. However, all variations and modifications which are obvious to those skilled in the art to which the present invention pertains are considered to be within the scope of the protection granted by this Letters Patent.

What is claimed is:

1. An offset printer comprising:

a rotating image member for receiving colorant from a print head to form an image on the rotating image member;

a motor having rotational output that is coupled to the rotating image member for rotating the rotating image member at a first surface speed and in a first rotational direction;

a transfix member for forming a nip with the rotating image member to transfer the image from the rotating image member to media in the nip, the transfix member being moveable from a first position, in which the transfix member does not form a nip with the rotating image member, to a second position, in which the transfix member forms the nip with the rotating image member; and an endless belt coupled to the rotating image member and the transfix member when the transfix member is in the first position to rotate the transfix member at a second surface speed that corresponds with the first surface speed and in a direction opposite to the first rotational direction.

2. The printer of claim 1 further comprising:

a first gear coupled to the rotating image member to enable the first gear to rotate at a speed corresponding to the first surface speed of the rotating image member;

a second gear in intermeshing relationship with the first gear to rotate the second gear in a direction opposite to the first rotational direction for the rotating image member; and the endless belt being coupled to the second gear to enable the first gear to rotate the endless belt to drive the transfix member at the second surface speed and in a direction opposite to the direction of rotation for the rotating image member when the transfix member is in the first position.

3. The printer of claim 2 further comprising:

a cylindrical body fixedly mounted to the second gear, the cylindrical body rotates with the second gear as the second gear is driven by the first gear;

a pulley mounted to the transfix member; and the endless belt being mounted about the cylindrical body and the pulley to enable the endless belt to rotate the cylindrical body and the pulley when the transfix member is in the first position.

4. The printer of claim 1 further comprising:

a first adjusting pulley positioned proximate an outside edge of the endless belt between the rotating image member and the transfix member; and a biasing member coupled to the first adjusting pulley to bias the first adjusting pulley towards the endless belt to enable the first adjusting pulley to remove slack from the endless belt in response to the transfix member moving from the first position to the second position.

5. The printer of claim 4 further comprising:

a second adjusting pulley positioned proximate an outside edge of the endless belt, which is opposed to the position of the first adjusting pulley; and the biasing member being coupled between the first adjusting pulley and the second adjusting pulley to bias the first and the second adjusting pulleys towards the endless belt to remove slack from the endless belt in response to the transfix member moving from the first position to the second position.

6. The printer of claim 4, the biasing member being a spring.

7. The printer of claim 5, the biasing member being a spring coupled to the first adjusting pulley and the second adjusting pulley to urge the first and the second adjusting pulleys towards one another.

8. A system for coordinating rotation of a transfix member with a rotating image member comprising:

a transfix member driver for generating rotational power; and a rotational transfer link for transferring rotational power from the transfix member driver to a transfix member to rotate the transfix member at a speed corresponding to a speed of a rotating image member and in a direction opposite to rotation of the rotating image member in response to the transfix member being located at a first position out of engagement with the rotating image member, the rotational transfer link being configured to disengage the transfix member from the transfix member driver in response to the transfix member moving to a second position to engage the rotating image member and form a nip for transferring an image from the rotating image member to a media in the nip.

9. The system of claim 8, the transfix member driver further comprising:

a first spur gear mounted to the rotating image member and centered on a longitudinal center axis of the rotating image member.

10. The system of claim 9, the rotational transfer link further comprising:

a second spur gear mounted independently of the rotating image member, the second spur gear having a cylindrical body offset from teeth of the second spur gear and the second spur gear being located to engage the first spur gear mounted to the rotating image member and be rotated in a direction opposite to a direction of rotation for the rotating image member;

a pulley mounted to the transfix member and centered on a longitudinal center axis of the transfix member; and an endless belt mounted about the cylindrical offset of the independently mounted second spur gear and the pulley.

11. The system of claim 8 further comprising:

a tension adjuster for adjusting tension in the rotational transfer link to remove slack from the rotational transfer link as the transfix member moves from the first position out of engagement with the rotating image member to the second position where the transfix member engages the rotating image member.

12. The system of claim 11, the tension adjuster further comprising:

a first adjusting pulley contacting the rotational transfer link; and a biasing member coupled to the adjusting pulley to urge the adjusting pulley towards the rotational transfer link to enable the rotational transfer link to remain in contact with the transfix member and the transfix member driver as the transfix member moves into engagement with the rotating image member.

13. The system of claim 12, the tension adjuster further comprising:

a second adjusting pulley located on a side of the rotational transfer link that is opposite the first adjusting pulley;

a second biasing member; and the first and the second biasing members are coupled to the first and the second adjusting pulleys and are located on opposite sides of the first and the second adjusting pulleys to pull the first and the second adjusting pulleys towards one another and into the rotational transfer link.

14. The system of claim 8, the transfix member driver comprising:

a variable speed electrical motor.

15. The system of claim 8, the rotational transfer link comprising:

a crossed belt coupled to the transfix member and the transfix member driver with a crossed pattern.

16. An offset printer comprising:

a rotating image member for receiving colorant from a print head to form an image on the rotating image member;

a motor having rotational output that is coupled to the rotating image member for rotating the rotating image member at a first surface speed;

a transfix member configured to form a nip with the rotating image member to transfer the image from the rotating image member to media in the nip, the transfix member being moveable from a first position, in which the transfix member does not form a nip with the rotating image member, to a second position, in which the transfix member forms the nip with the rotating image member;

a first gear coupled to the rotating image member to enable the first gear to rotate at a second surface speed corresponding to the first surface speed of the rotating image member;

a second gear in intermeshing relationship with the first gear to drive the second gear in a direction opposite to the rotating image member rotational direction; and an endless belt coupled to the second gear to enable the first gear to rotate the endless belt to drive the transfix member at the second surface speed and in the direction opposite the rotating image member rotational direction when the transfix member is in the first position.

17. The printer of claim 16 further comprising:

a first adjusting pulley positioned proximate an outside edge of the endless belt between the rotating image member and the transfix member; and a biasing member coupled to the first adjusting pulley to bias the first adjusting pulley towards the endless belt so the first adjusting pulley removes slack from the endless belt in response to the transfix member moving from the first position to the second position.

18. The printer of claim 17 further comprising:

a second adjusting pulley positioned proximate an outside edge of the endless belt, which is opposed to the position of the first adjusting pulley; and the biasing member being a spring coupled to the first adjusting pulley and the second adjusting pulley to urge the first and the second adjusting pulleys towards one another and the endless belt to remove slack from the endless belt in response to the transfix member moving from the first position to the second position.

* * * * *